US007270289B2

(12) United States Patent
Kish

(10) Patent No.: US 7,270,289 B2
(45) Date of Patent: Sep. 18, 2007

(54) WRITING INSTRUMENT HOLDER

(75) Inventor: Louis A. Kish, Santa Ana, CA (US)

(73) Assignee: Kish, LLC, Santa Ana, CA (US)

( * ) Notice: Subject to any disclaimer, the term of this patent is extended or adjusted under 35 U.S.C. 154(b) by 289 days.

(21) Appl. No.: 11/021,881

(22) Filed: Dec. 23, 2004

(65) Prior Publication Data

US 2005/0103917 A1 May 19, 2005

Related U.S. Application Data

(63) Continuation-in-part of application No. 10/632,429, filed on Jul. 31, 2003, now Pat. No. 6,854,681.

(60) Provisional application No. 60/454,008, filed on Mar. 13, 2003, provisional application No. 60/402,412, filed on Aug. 9, 2002.

(51) Int. Cl.
*B65H 75/48* (2006.01)
*B43K 23/02* (2006.01)
*A45F 5/02* (2006.01)

(52) U.S. Cl. ..... 242/280; 224/162; 224/251; 401/131

(58) Field of Classification Search ..... 242/380, 242/402; 224/162, 251; 401/131
See application file for complete search history.

(56) References Cited

U.S. PATENT DOCUMENTS

| | | | | |
|---|---|---|---|---|
| 245,257 | A | 8/1881 | Wright | |
| 264,593 | A | 9/1882 | Wright | |
| 706,697 | A | 8/1902 | Sims | |
| 1,576,965 | A | 3/1926 | Giese | |
| 1,577,272 | A | 3/1926 | Treadaway | |
| 1,799,688 | A | 4/1931 | Jaffe | |
| 4,884,730 | A | 12/1989 | Carpenter | |
| 5,358,348 | A | 10/1994 | Kennedy | |
| 5,971,238 | A | 10/1999 | Malvasi et al. | |
| 6,382,481 | B1 | 5/2002 | McIlmoil | |
| 6,499,899 | B2 | 12/2002 | Sawyer | |
| 6,854,681 | B2 * | 2/2005 | Kish | 242/380 |
| 2004/0026556 | A1 * | 2/2004 | Kish | 242/380 |

* cited by examiner

*Primary Examiner*—Gene O. Crawford
*Assistant Examiner*—Sang Kim
(74) *Attorney, Agent, or Firm*—Cislo & Thomas, LLP

(57) ABSTRACT

A writing instrument holder comprises a substantially funnel-shaped body configured to hold concurrently one writing instrument internally and another writing instrument externally. The writing instruments are frictionally held in a substantially conical fashion. A retractable fastener is coupled to one end of the substantially funnel-shaped body.

21 Claims, 5 Drawing Sheets

WRITING INSTRUMENT HOLDER

CROSS-REFERENCE TO RELATED APPLICATIONS

This Application is a continuation-in-part application of U.S. patent application Ser. No. 10/632,429, filed on Jul. 31, 2003 now U.S. Pat. No. 6,854,681, which claims the benefit of U.S. Provisional Application No. 60/402,412, filed on Aug. 9, 2002 and U.S. Provisional Application No. 60/454,008, filed on Mar. 13, 2003. The content of these three applications is incorporated hereby in its entirety by reference.

BACKGROUND

Many people use writing, marking or pointing instruments (hereinafter referred to generally as "instruments") in their trade, hobby or leisure time. These instruments may be in the shape of a carpenter's pencil, felt tip marker, regular pencil, golf pencil, "clicker" or stick pen, stylus or a pointer. In many situations the user of a writing instrument is moving from place to place as he/she performs his/her tasks. One of the more frustrating and time wasting aspects of these tasks is when the user incidentally drops or misplaces his/her writing instrument. The need exists for a device that can securely hold a writing instrument without sacrificing accessibility of the instrument.

SUMMARY

Exemplary embodiments disclosed herein are generally directed to a writing instrument holder.

In accordance with one aspect of the invention, the writing instrument holder comprises a substantially funnel-shaped body configured to hold concurrently at least one writing instrument internally and at least one writing instrument externally. The writing instruments are being held in a substantially conical fashion. A retractable fastener is coupled to one end of the substantially funnel-shaped body.

In accordance with another aspect of the invention, the writing instrument holder comprises a substantially funnel-shaped body configured internally to frictionally hold a first writing instrument. The substantially funnel-shaped body is equipped with at least one external receptacle adapted to hold concurrently a second writing instrument. A retractable fastener is coupled to one end of the substantially funnel-shaped body.

In accordance with yet another aspect of the invention, the writing instrument holder comprises a substantially funnel-shaped body configured internally to frictionally hold a first writing instrument. The substantially funnel-shaped body includes at least one side wall aperture adapted to hold concurrently a second writing instrument. A retractable fastener is coupled to one end of the substantially funnel-shaped body.

These and other aspects of the invention will become apparent from a review of the accompanying drawings and the following detailed description of the invention.

BRIEF DESCRIPTION OF THE DRAWINGS

The invention is generally shown by way of reference to the accompanying drawings in which.

DETAILED DESCRIPTION

The detailed description set forth below in connection with the appended drawings is intended as a description of exemplary embodiments and is not intended to represent the only forms in which the exemplary embodiments may be constructed and/or utilized. The description sets forth the functions and the sequence of steps for constructing and operating the exemplary embodiments in connection with the illustrated embodiments. However, it is to be understood that the same or equivalent functions and sequences may be accomplished by different embodiments that are also intended to be encompassed within the spirit and scope of the invention.

Some embodiments of the invention will be described in detail with reference to the related drawings of FIGS. 1-10. Additional embodiments, features and/or advantages of the invention will become apparent from the ensuing description or may be learned by practicing the invention. In the figures, the drawings are not to scale with like numerals referring to like features throughout both the drawings and the description.

Figure 1:
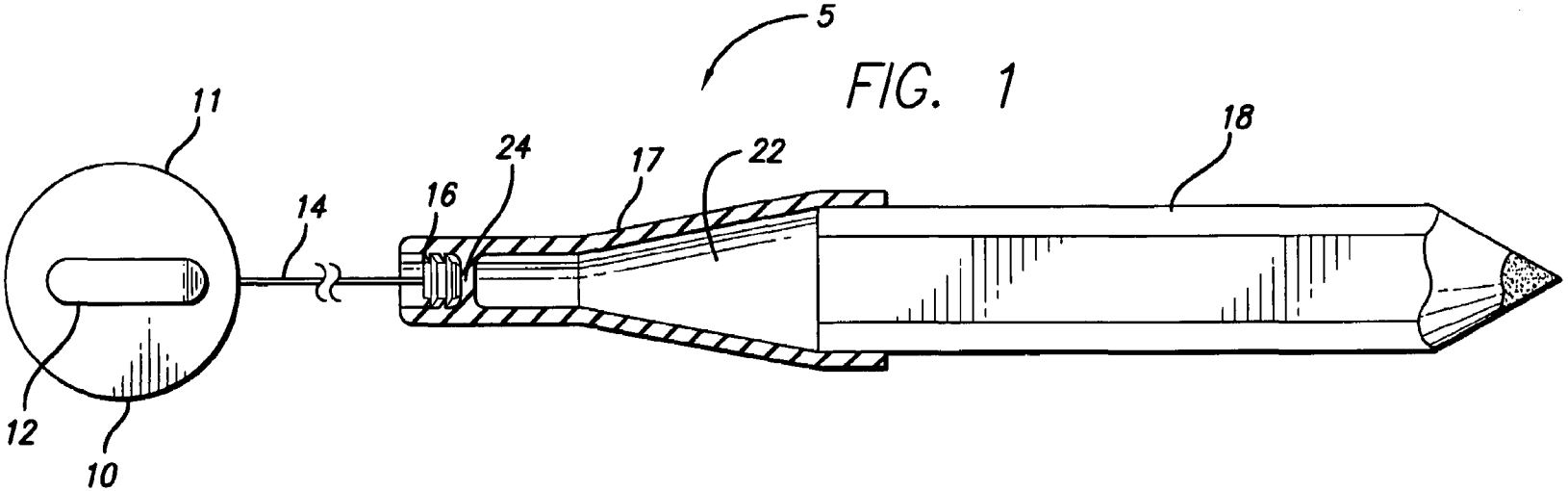
FIG. 1 is a cross-sectional view of an exemplary embodiment engaging a relatively large diameter instrument.

Turning to the drawings, FIG. 1 is directed to one exemplary embodiment of a retractable instrument holder 5. As shown in FIG. 1, the retractable instrument holder 5 is composed of a retractor 11 coupled to a flexible retaining member 17. In the exemplary embodiment as shown in FIG. 1, retractor 11 is a conventional type retractor having a housing 10 and a fastening means 12 for attaching retractor 11 to an individual's clothing, or a clipboard, an ear sun visor, or a pencil holder. The fastening means 12 may be a belt clip or a bulldog clip, clamps such as alligator clamps, hooks or other coupling structures known or developed in the art. The retractor 11 has an internal retractable reel connected to a cable 14 that can be extended approximately 2 to approximately 3 feet from the reel. As those skilled in the art will appreciate, the length of the cable 14 may be varied to accommodate various intended uses.

Figure 2:
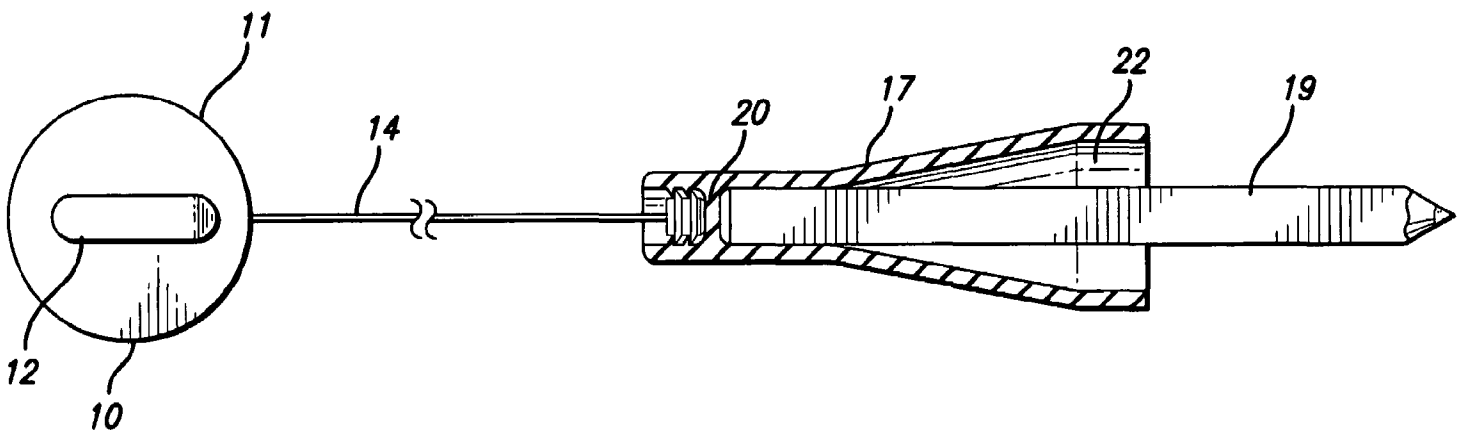
FIG. 2 is a cross-sectional view of an exemplary embodiment engaging a relatively small diameter instrument.
Figure 3:
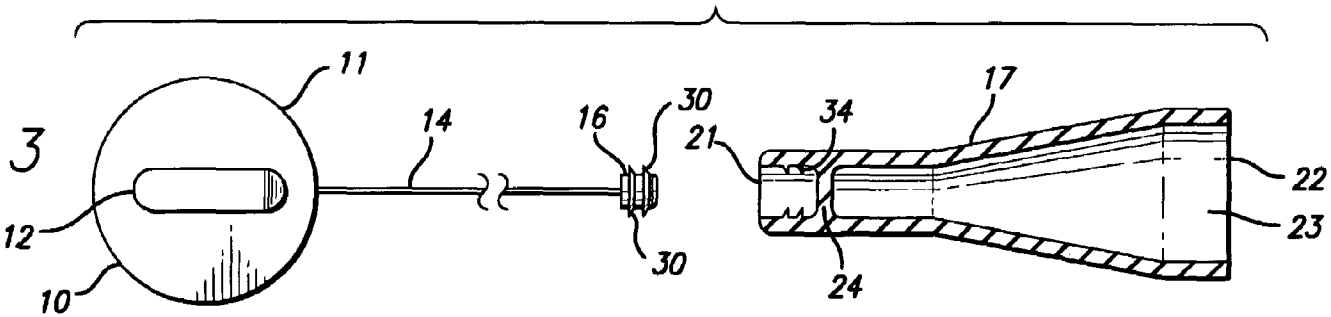
FIG. 3 is an exploded cross-sectional view of an exemplary embodiment.
Figure 5:
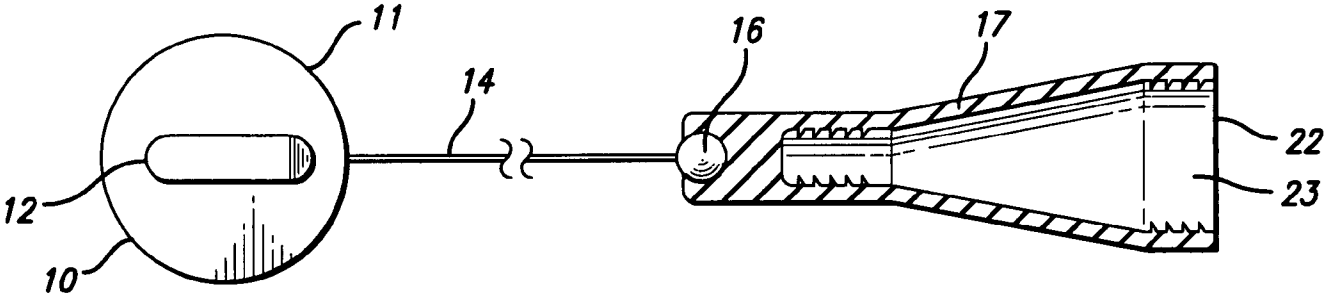
FIG. 5 is a cross-sectional view of another exemplary embodiment.

As shown in FIG. 1, a plug 16 is attached to one end of the cable 14. According to one exemplary embodiment, the plug 16 may be a generally cylindrical structure having annular ridges 30 provided about the outer diameter as shown in FIGS. 1-3. In another exemplary embodiment, the plug 16 may not include the annular ridges on the outer diameter. In yet another exemplary embodiment, the plug 16 may be a generally spherical structure as shown in FIG. 5. In another exemplary embodiment, the plug 16 may be provided with threads 32 on the outer diameter. As those skilled in the art will appreciate, the plug 16 may have a plurality of shapes and be made from a plurality of materials such as, but not limited to, plastic, metal, alloys, ceramics, or the like.

As shown in FIG. 1, the plug 16 is inserted into a bore 21 that is positioned at one end of the flexible retaining member 17. According to one exemplary embodiment, the plug 16 is held by friction fit against the inner walls of the bore 21. To achieve a friction fit, the diameter of the plug 16 may be slightly larger than the diameter of the bore 21. In other exemplary embodiment, the plug 16 having annular ridges 30 may engage corresponding annular ridges 34 provided on the bore 21 to retain the plug 16 in the bore 21. In yet another exemplary embodiment, the threads 32 provided on the plug 16 may engage and mate with corresponding threads 36 provided on the walls of the bore 21. In another exemplary embodiment, the plug 16 may be snap-fitted into the bore 21 as shown in FIG. 5.

Figure 6:
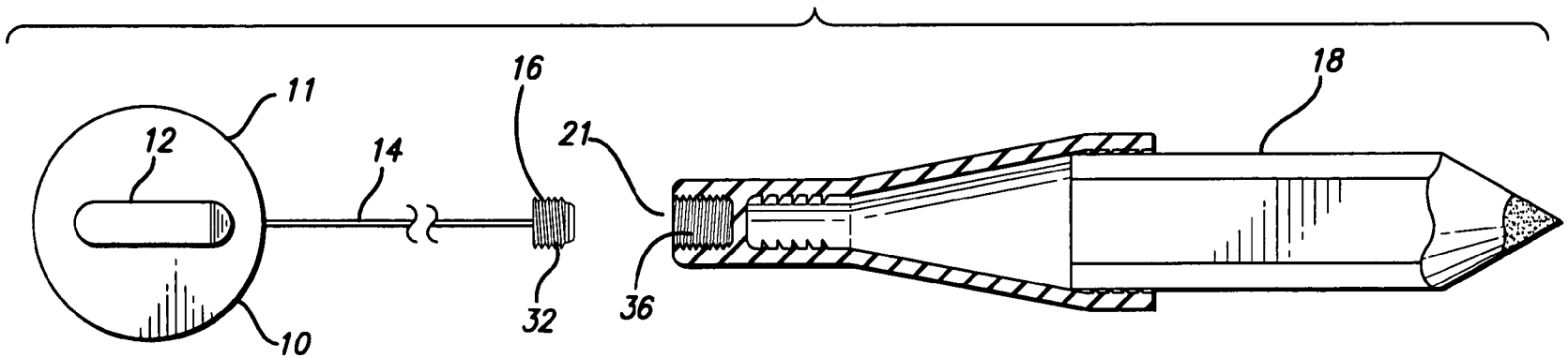
FIG. 6 is a cross-sectional view of yet another exemplary embodiment.

As shown in FIG. 1, the flexible retaining adapter 17 has a generally funnel-shaped body. Adapter 17 has a bore 21 that is sized to receive a plug 16. The bore 21 may have smooth inner walls in one exemplary embodiment. In another exemplary embodiment, the walls may have annular ridges 34 extending into the bore 21 as shown in FIG. 3. In yet another exemplary embodiment, the bore 21 may have threads along the inner walls of the bore 21 as shown in FIG. 6. Adapter 17 also includes a wall 24 that separates the bore 21 from the main cavity 22. The main cavity 22 has a cross-section that diminishes as it approaches the wall 24 that separates the cavity 22 from the bore 21. The decrease in diameter of the main cavity walls provides a universal adapter that is sized to engage a wide variety of writing, marking, or pointing instruments of different diameters to be securely held by a frictional fit.

Adapter 17 may be made of a plurality of materials that have the characteristic of being relatively stiff, yet slightly resilient. Exemplary materials include, but are not limited to, vinyl or rubber.

According to various exemplary embodiments, as shown in FIGS. 1-3, the inner walls of the main cavity 22 are generally smooth. In alternate embodiments, as shown in FIGS. 5 and 6, the inner walls of the main cavity 22 may be provided with annular ridges that extend away from the walls of the main cavity 22.

Adapter 17 is capable of housing various instruments of different diameter sizes due to the resilient nature of the material and the varying diameters of the cavity 22. For instance, as shown in FIG. 1, adapter 17 is capable of housing a writing instrument having a relatively large diameter such as a carpenter's pencil 18. Such large-diameter writing instrument is inserted into the mouth of adapter 17 and the inner walls of the adapter engage the outer walls of the writing instrument. Adapter 17 is capable of holding a writing instrument of relatively small diameter, such as writing instrument 19 (FIG. 2). That is, the inner walls of cavity 22 that are near the inner wall 24 are capable of engaging the small-diameter instrument. Furthermore, adapter 17 is capable of engaging instruments having irregular cross-sections so long as the instruments are inserted into the cavity 22 to sufficiently form a tight frictional fit with the instrument. Additionally, the instrument may be removed from the cavity 22 with a sufficient pulling force to overcome the frictional fit and be replaced with another instrument.

In another exemplary embodiment, retractor 11 includes a pencil-rod attachment 25. This attachment 25 is a generally elongated cylindrical structure. The attachment 25 is sized to be inserted in a bore 38 or a press-in clip bracket that is found on most hand-pulled or motorized golf carts. According to one exemplary embodiment, the attachment 25 has a diameter that is approximately the same diameter of a typical golf pencil. As those skilled in the art will appreciate, the diameter and/or length of the attachment 25 may be varied depending upon the intended application.

Figure 4:
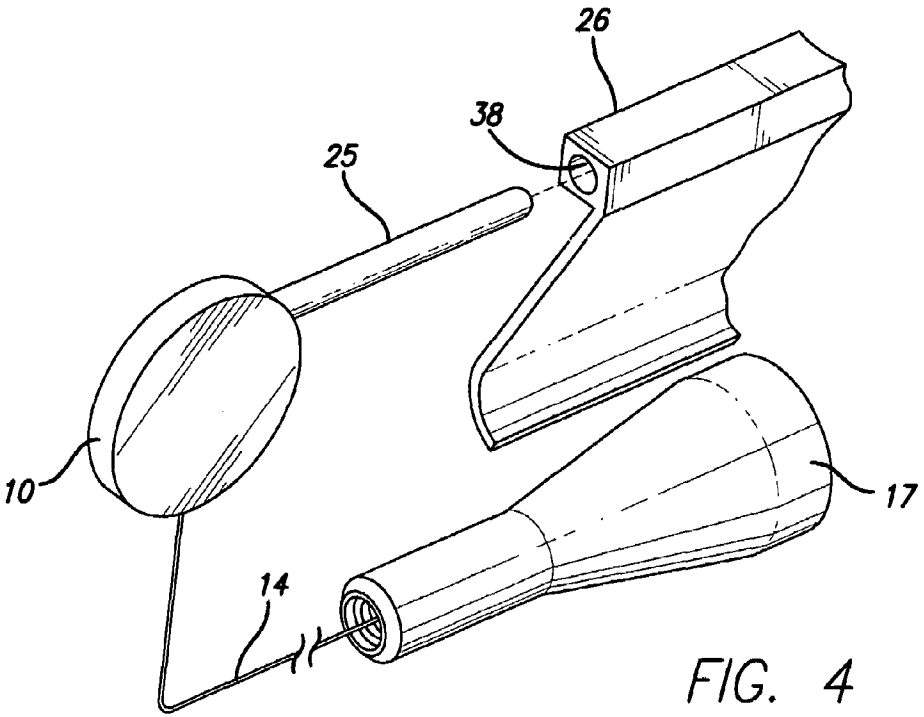
FIG. 4 is an exploded perspective view of an alternate exemplary embodiment.

As shown in FIG. 4, the attachment 25 would be inserted into the bore 38 that is found on a golf cart and the writing instrument such as a golf pencil (not shown) would be inserted into the mouth of the adapter. Accordingly, when the user wants to access or use the writing instrument, the user would grasp the writing instrument and be able to extend the writing instrument away from retractor housing 10 and use the writing instrument. When finished, the user may release the writing instrument, and the instrument will be held in an easily accessible location to the user for future use.

Figures 7, 8:
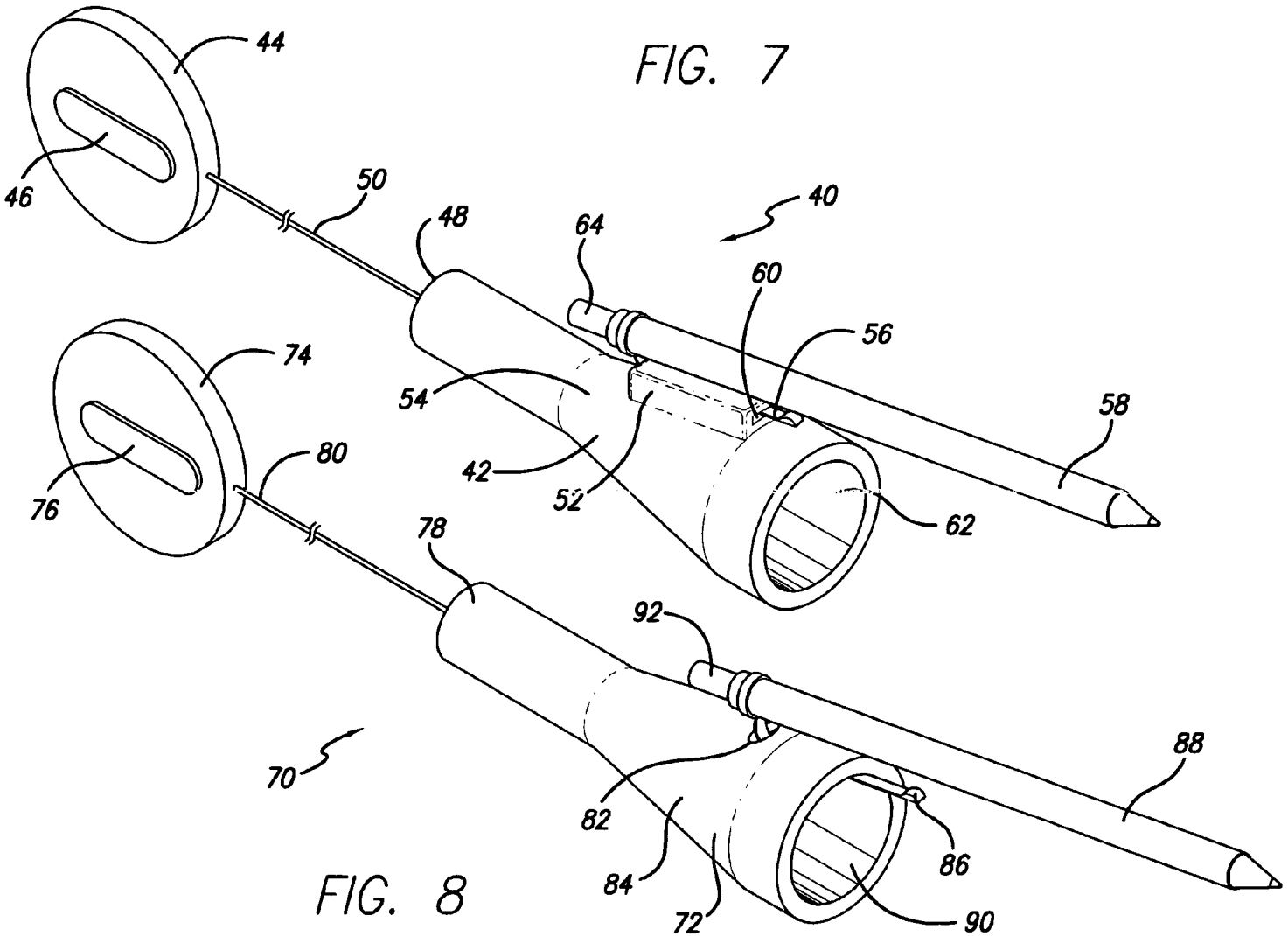
FIG. 7 is a perspective view of a writing instrument holder in accordance with an exemplary embodiment of the present invention.
FIG. 8 is a perspective view of a writing instrument holder in accordance with another exemplary embodiment of the present invention.

FIG. 7 is a perspective view of a writing instrument holder 40 in accordance with an exemplary embodiment of the present invention. Writing instrument holder 40 comprises a generally funnel-shaped body 42 that may be configured internally to frictionally hold a writing/marking instrument, such as a pen, pencil, marker or the like, in a variety of ways including, but not limited to, the embodiments generally described hereinabove in reference to FIGS. 1-6. For purposes of describing the present invention, writing or marking instrument or the like would be generally defined as "writing instrument."

Writing instrument holder 40 also comprises a fastener 44 which may be removably attached to a person's clothing, belt, clipboard, sun visor and/or the like. For example, writing instrument holder 40 may be attached to a shirt pocket or belt via clip-on portion 46 of fastener 44 (FIG. 7). Fastener 44 includes an internal retractable reel (not shown) which is connected to a back end 48 of funnel-shaped body 42 via cable 50. The length of cable 50 may be varied according to the needs of the user.

Funnel-shaped body 42 is equipped with an external receptacle 52 which may be integrally molded on an exterior surface 54 of funnel-shaped body 42 and adapted to hold a clip 56 of a writing/marking instrument 58. In one embodiment, external receptacle 52 has a generally box-like configuration including a channel 60 adapted to receive clip 56 of writing/marking instrument 58, as generally depicted in FIG. 7. Other external holding configurations are possible, providing such other configurations do not depart from the intended purposes of the present invention.

The user slips clip 56 of writing/marking instrument 58 in/out of channel 60, as needed. The user can store concurrently another writing/marking instrument within main cavity 62 of funnel-shaped body 42 in the manner generally described hereinabove in reference to FIGS. 1-6. Funnel-shaped body 42 stores concurrently two writing/marking instruments in a substantially conical fashion. The user has convenient access to a clicker portion 64 of writing/marking instrument 58 while clip 56 is being held by receptacle 60. Funnel-shaped body 42 may be provided with more than one receptacle, if needed.

FIG. 8 is a perspective view of a writing instrument holder 70 in accordance with another exemplary embodiment of the present invention. Writing instrument holder 70 comprises a generally funnel-shaped body 72 that may be configured internally to frictionally hold a writing/marking instrument, such as a pen, pencil, marker or the like, in a variety of ways including, but not limited to, the embodiments generally described hereinabove in reference to FIGS. 1-6.

Writing instrument holder 70 also comprises a fastener 74 which may be removably attached to a person's clothing, belt, clipboard, sun visor and/or the like. For example, writing instrument holder 70 may be attached to a shirt pocket or belt via clip-on portion 76 of fastener 74 (FIG. 8). Fastener 74 includes an internal retractable reel (not shown) which is connected to a back end 78 of funnel-shaped body 72 via cable 80. The length of cable 80 may be varied according to the needs of the user.

Funnel-shaped body 72 is equipped with an aperture 82 which may be formed on a side wall 84 of funnel-shaped body 72 and adapted to hold a clip 86 of a writing/marking instrument 88. Other external holding configurations may be utilized, providing such other configurations do not deviate from the intended scope and spirit of the present invention.

The user slips clip 86 of writing/marking instrument 88 in/out of aperture 82, as needed. Depending on the size of the slipped in clip 86 (FIG. 8), the user may be able to store concurrently another writing/marking instrument within main cavity 90 of funnel-shaped body 72 in the manner generally described hereinabove in reference to FIGS. 1-6. In such case, funnel-shaped body 72 would store concurrently two writing/marking instruments in a substantially conical fashion. The user has convenient access to a clicker portion 92 of writing/marking instrument 88 while a portion of clip 86 is being held within main cavity 90 via aperture 82 (FIG. 8). Aperture 82 may be disposed further toward back end 78 to allow the complete insertion of clip 86 in main cavity 90, as needed. Funnel-shaped body 72 may be provided with more than one aperture, if needed.

Figure 9:
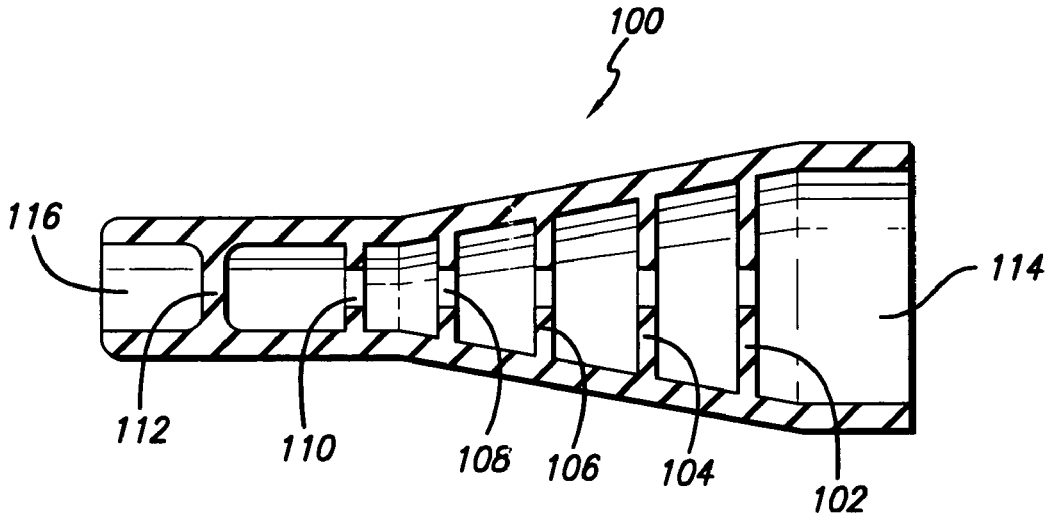
FIG. 9 is a cross-sectional view of the body of a writing instrument holder in accordance with an exemplary embodiment of the present invention.

FIG. 9 is a cross-sectional view of a generally funnel-shaped body 100 of a writing instrument holder in accordance with an exemplary embodiment of the present invention. The interior of funnel-shaped body 100 is equipped with a plurality of integral rings 102-112 adapted to frictionally hold a variety of odd-shaped writing/marking instruments, such as pens, pencils, carpenter's pencils, markers and the like. Integral rings 102-112 are generally of diminishing diameter to allow main cavity 114 of funnel-shaped body 100 to securely grip and hold a variety of writing/marking instrument sizes and configurations.

Integral rings 102-112 may be molded from the same material that is used to manufacture funnel-shaped body 100. For example, rings 102-112 and funnel-shaped body 100 may be molded from resilient material such as synthetic rubber, vinyl and the like. Other suitable materials that exhibit grip-like functionality may be utilized, as needed. Funnel-shaped body 100 may be coupled at a back end 116 to a retractable fastener of the type generally described hereinabove in reference to FIGS. 1-8.

Figure 10:
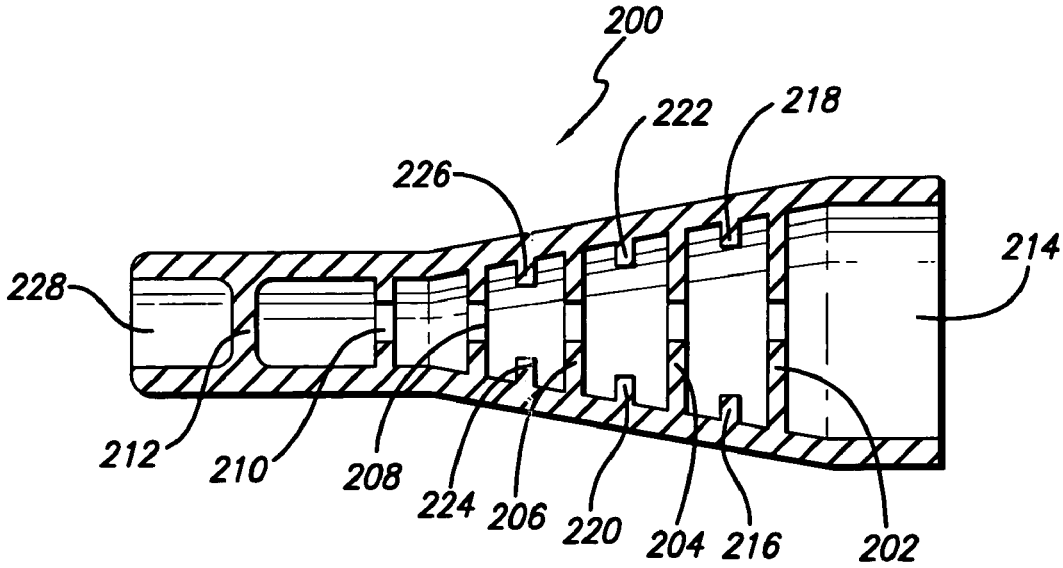
FIG. 10 is a cross-sectional view of the body of a writing instrument holder in accordance with another exemplary embodiment of the present invention.

FIG. 10 is a cross-sectional view of a generally funnel-shaped body 200 of a writing instrument holder in accordance with another exemplary embodiment of the present invention. The interior of funnel-shaped body 200 is equipped with a plurality of integral rings and stubs 202-212 and 216-226, respectively, adapted to frictionally hold a variety of odd-shaped writing/marking instruments, such as pens, pencils, carpenter's pencils, markers and the like.

Integral rings 202-212 are generally of diminishing diameter to allow main cavity 214 of funnel-shaped body 200 to securely grip and hold a variety of writing/marking instrument sizes and configurations. Integral stubs 216-226 are interspersed in between rings 202-208, as generally shown in FIG. 10, to enhance the gripping and holding capability of main cavity 214. The number of integral rings and/or stubs used may be varied, as needed. For example, although not currently shown, additional stubs may be formed and dispersed in between integral rings 208-212 of FIG. 10.

Integral rings and stubs 202-212, 216-226 may be molded from the same material that is used to manufacture funnel-shaped body 200. For example, rings and stubs 202-212, 216-226 and funnel-shaped body 200 may be molded from resilient material such as synthetic rubber, vinyl and the like. Other suitable materials that exhibit grip-like functionality may be utilized, as needed. Funnel-shaped body 200 may be coupled at a back end 228 to a retractable fastener of the type generally described hereinabove in reference to FIGS. 1-8.

Other components and/or configurations may be utilized, provided such other components and/or configurations remain within the intended scope of the present invention. A person skilled in the art would appreciate that exemplary embodiments described hereinabove are merely illustrative of the general principles of the present invention. Other modifications or variations may be employed that are within the scope of the invention. Thus, by way of example, but not of limitation, alternative configurations may be utilized in accordance with the teachings herein. Accordingly, the drawings and description are illustrative and not meant to be a limitation thereof.

Moreover, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Thus, it is intended that the invention cover all embodiments and variations thereof as long as such embodiments and variations come within the scope of the appended claims and their equivalents.

What is claimed is:

1. A writing instrument holder, comprising:

a substantially funnel-shaped body configured to hold concurrently at least one writing instrument internally and at least one writing instrument externally; and a retractable fastener coupled to one end of said substantially funnel-shaped body, the interior of said substantially funnel-shaped body being equipped with a plurality of integral rings configured to frictionally hold said at least one writing instrument, wherein said integral rings are of diminishing diameter to allow said substantially funnel-shaped body to securely grip and hold said at least one writing instrument.

2. The writing instrument holder of claim 1, wherein said integral rings are made of resilient material.

3. The writing instrument holder of claim 1, wherein the interior of said substantially funnel-shaped body is further equipped with a plurality of integral stubs adapted to frictionally hold said at least one writing instrument.

4. The writing instrument holder of claim 3, wherein said integral stubs are interspersed in between said integral rings to enhance the gripping and holding capability of said substantially funnel-shaped body.

5. The writing instrument holder of claim 4, wherein said integral stubs are made of resilient material.

6. The writing instrument holder of claim 4, wherein said integral stubs and said substantially funnel-shaped body are molded from the same material.

7. The writing instrument holder of claim 1, wherein said integral rings and said substantially funnel-shaped body are molded from the same material.

8. A writing instrument holder, comprising:

a substantially funnel-shaped body configured internally to frictionally hold a first writing instrument, said substantially funnel-shaped body being equipped with at least one external receptacle configured to hold concurrently a second writing instrument; and a retractable fastener coupled to one end of said substantially funnel-shaped body, the interior of said substantially funnel-shaped body being equipped with a plurality of integral rings configured to frictionally hold said first writing instrument, wherein said integral rings are of diminishing diameter to allow said substantially funnel-shaped body to securely grip and hold said first writing instrument.

9. The writing instrument holder of claim 8, wherein said integral rings are made of resilient material.

10. The writing instrument holder of claim 8, wherein the interior of said substantially funnel-shaped body is further equipped with a plurality of integral stubs adapted to frictionally hold said first writing instrument.

11. The writing instrument holder of claim 10, wherein said integral stubs are interspersed in between said integral rings to enhance the gripping and holding capability of said substantially funnel-shaped body.

12. The writing instrument holder of claim 11, wherein said integral stubs are made of resilient material.

13. The writing instrument holder of claim 11, wherein said integral stubs and said substantially funnel-shaped body are molded from the same material.

14. The writing instrument holder of claim 8, wherein said integral rings and said substantially funnel-shaped body are molded from the same material.

15. A writing instrument holder, comprising:

a substantially funnel-shaped body configured internally to frictionally hold a first writing instrument, said substantially funnel-shaped body including at least one side wall aperture configured to hold concurrently a second writing instrument; and a retractable fastener coupled to one end of said substantially funnel-shaped body, the interior of said substantially funnel-shaped body being equipped with a plurality of integral rings configured to frictionally hold said first writing instrument, wherein said integral rings are of diminishing diameter to allow said substantially funnel-shaped body to securely grip and hold said first writing instrument.

16. The writing instrument holder of claim 15, wherein said integral rings are made of resilient material.

17. The writing instrument holder of claim 15, wherein the interior of said substantially funnel-shaped body is further equipped with a plurality of integral stubs adapted to frictionally hold said first writing instrument.

18. The writing instrument holder of claim 17, wherein said integral stubs are interspersed in between said integral rings to enhance the gripping and holding capability of said substantially funnel-shaped body.

19. The writing instrument holder of claim 18, wherein said integral stubs are made of resilient material.

20. The writing instrument holder of claim 18, wherein said integral stubs and said substantially funnel-shaped body are molded from the same material.

21. The writing instrument holder of claim 15, wherein said integral rings and said substantially funnel-shaped body are molded from the same material.

* * * * *